United States Patent [19]

Ecomard et al.

[11] 4,394,964

[45] Jul. 26, 1983

[54] FUEL PUMP-INJECTOR UNITARY ASSEMBLY FOR INTERNAL COMBUSTION ENGINE

[75] Inventors: Andre Ecomard, Marly le Roi; Philippe Pinchon, Rueil-Malmaison, both of France

[73] Assignee: Institut Francais Du Petrole, Rueil-Malmaison, France

[21] Appl. No.: 277,543

[22] Filed: Jun. 26, 1981

[30] Foreign Application Priority Data

Jun. 27, 1980 [FR] France ..... 80 14369

[51] Int. Cl.[3] ..... F02M 45/00

[52] U.S. Cl. ..... 239/90; 239/91; 239/125

[58] Field of Search ..... 239/88, 90, 91, 95, 239/125, 533.2, 533.3, 533.6, 533.9, 584; 123/500, 501, 503, 506

[56] References Cited

U.S. PATENT DOCUMENTS

| | | | |
|---|---|---|---|
| 2,717,805 | 10/1955 | Seifert et al. | 239/90 |
| 2,872,247 | 2/1959 | Shallenberg | 239/95 |
| 3,146,949 | 10/1964 | Reiners | 239/90 |
| 3,566,849 | 3/1971 | Frick | 239/88 |
| 3,758,241 | 10/1973 | Eheim | 123/503 |
| 3,999,529 | 12/1976 | Davis | 123/500 |
| 4,146,178 | 3/1979 | Bailey | 239/90 |

*Primary Examiner*—John J. Love
*Assistant Examiner*—Jon Rastello
*Attorney, Agent, or Firm*—Millen & White

[57] ABSTRACT

A fuel pump-injector unitary assembly comprises a plunger slidable in a bore and provided with a longitudinal passage-way, in combination with a metering ring surrounding the plunger and housed in an annular chamber of the injector body. The plunger is movable into a first or upper postion in which fuel is admitted into the lower part of the injector bore through an inlet port, and a second or lower position in which the tapered lower end of the plunger obturates fuel spray nozzles provided at the bottom of the bore. Fuel metering results from the cooperation of an inclined ramp of the ring with a fuel discharge duct transversely extending through the plunger and connected with the longitudinal passage-way thereof. Relative rotation of the metering ring and of the plunger permits adjustment of the injected fuel charge.

10 Claims, 11 Drawing Figures

FUEL PUMP-INJECTOR UNITARY ASSEMBLY FOR INTERNAL COMBUSTION ENGINE

BACKGROUND OF THE INVENTION

The present invention relates to a pump-injector unitary assembly to achieve both fuel metering and fuel injection in an internal combustion engine.

Fuel metering pumps are already known in the art and for example described in Britist Pat. No. 139,742.

From U.S. Pat. No. 3,131,866 and the paper "simulation of the Cummins Diesel Injection System" of Andrew Rosselli and Pat Badgley presented to the Society of Automotive Engineers No. 710,570, there is already known a fuel injector comprising an injector body provided with an axial bore whose bottom is traversed by at least one fuel spray nozzle.

An inlet for pressurized fuel opens in this bore near the bottom thereof, this duct being connected with a fuel inlet circuit. A plunger or needle is slidably mounted in this bore between a first or upper position, where this plunger is spaced from the bore bottom, and a second or lower position at the end of the injection, where the tip or tapered end of this plunger obturates the fuel spray nozzles by contact with the bottom of the bore.

The displacements of the plunger are controlled by the assembly of a cam a push rod and a rocker-arm, against the action of a return spring.

When using such an injector, the injected fuel charge is adjusted by metering the amount of fuel admitted into the bore through the admission duct.

The bore is filled with a greater or lesser fuel quantity depending on the fuel charge to be injected, at the moment when the plunger begins its downward stroke for discharging fuel.

To this end fuel is supplied to the inlet port of the pump-injector assembly under a pressure varying in relation with the position of the gas pedal and the engine running speed. Thus, the fuel quantity admitted into the bore varies according to the inlet pressure and the duration of the fuel metering period (this period being inversely proportional to the engine running speed), hence the designation of P-T (i.e. Pressure-Time) system.

The drawbacks of such systems are to be found on the one hand in the difficulty of balancing the fuel flow rates delivered by the different injectors in a multi-cylinder engin, due to the importance of an accurate calibration of the fuel inlet port in each injector, and, on the other hand in the methd itself of automatically controlling the injection, through the fuel supply pressure.

Other injection systems are described in the German Patent Application No. 2 719 228 and the French Pat. No. 1 108 081, these systems comprising a pump-type device for transferring the metered fuel quantity into that portion of the injector where the injection nozzles open. In such prior devices gases ar admitted into the injection system and not only the beginning of the injection varies with the fuel charge due to the high compressibility of these gases, but furthermore, the beginnng of the fuel injection cannot be known with accuracy.

SUMMARY OF THE INVENTION

The problem of the fuel charge metering is solved according to the invention in an injector of the aboveconsidered type by providing a pump-injector unitary assembly which comprises in combination:

(a) a transfer passage-way provided in the plunger and communicating at a first end with a fuel discharge duct when the plunger is in its upper position, this fuel discharge duct openng on the wall of the bore with the transfer passageway opening at its second end, at the lower or free end of the plunger, so that said second end of the transfer passage-way is obturated by contact with the bottom of the bore in said second position of the plunger, (b) a metering ring surrounding the plunger and housed in an annular chamber of the injector body wherein said bore and said discharge duct open, this ring having an upper edge of which at least a portion is adapted to control the beginnng of the fuel injection by obturating said first end of the transfer passage-way when the plunger is displaced towards the bottom of the bore, and (c) means for adjusting the position of said metering ring.

In a first embodiment the longitudinal passage-way is formed by a groove provided in the wall of the plunger.

In a second embodiment, the longitudinal passage-way is formed by an axial bore in the plunger, this bore opening through two orifices at different levels of the plunger wall.

According to another embodiment, the pump-injector assembly comprises a push rod co-operating with means for displacing this plunger, this push rod being slidably mounted in a cylindrical recess of the plunger or needle in communication with the transfer passage-way.

BRIEF DESCRIPTION OF THE DRAWINGS

An embodiment of the invention is illustrated by the accompanying drawings wherein.

DETAILED DISCUSSION OF THE INVENTION

Figure 2A:
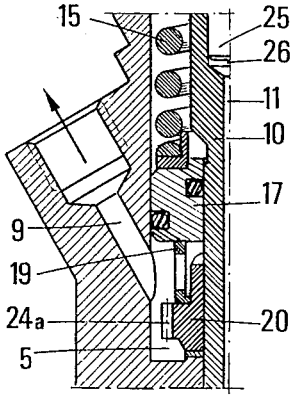
FIG. 2A is a cross-section along line A—A of FIG. 2.
Figure 2:
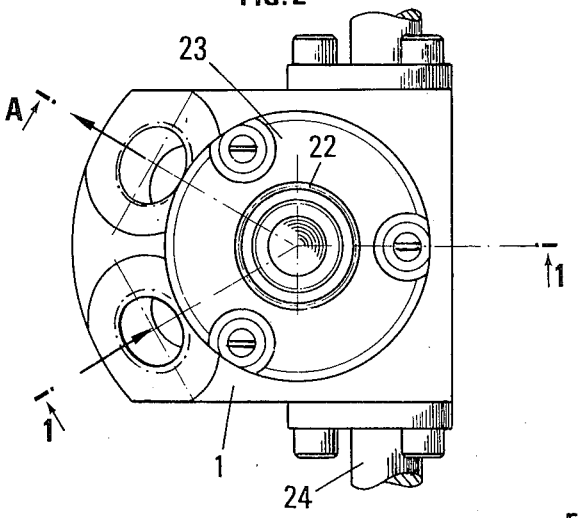
FIG. 2 is a top view showing the orifices of the fuel inlet and fuel outlet ports.

The illustrated pump-injector assembly comprises an injector body 1 having an axial bore 2 whose bottom or lower end 3 is traversed by at least a spray nozzle 4 through which fuel injection is effected. The upper end of this bore opens in an annular chamber 5 of greater diameter. A duct 6, provided with a non-return valve 7 and connected with a circuit spplying fuel under pressure (not shown) provides for fluid supply into the bore 2, where this duct opens at 8 near the bottom 3 of the bore. In the chamber 5 opens a discharge duct 9 (FIG. 2A) which is connected with a discharge or return line or circuit (not shown) through which the fuel flows back to the fluid tank.

Figure 1:
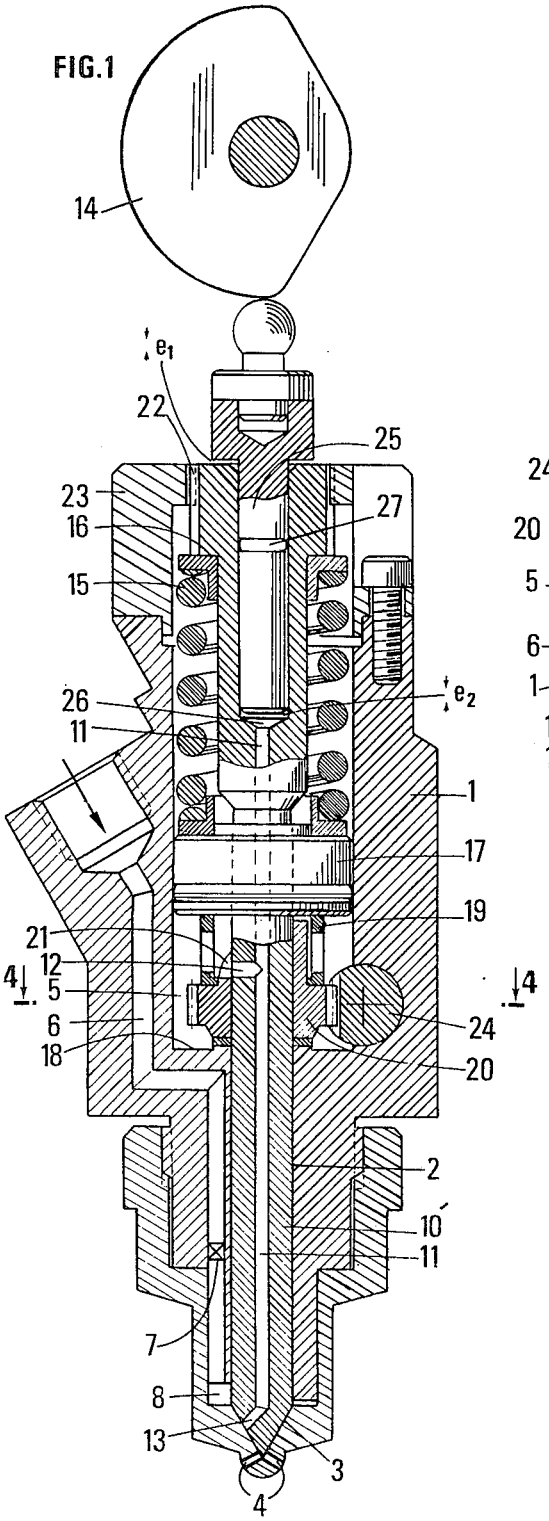
FIG. 1 illustrates the pump-injector assembly in longitudinal cross-section.

A plunger or needle 10 is slidable in the bore 2 between a first or upper position in which this plunger is spaced from the bottom 3 of the bore and a second or lower position shown in FIG. 1, in which this plunger is applied against said bottom.

The plungr 10 comprises a transfer passage-way 11 openng on the plunger wall through a first port 12 located at the level of the chamber 5 and through a second port 13 located at the free end of the plunger, this second port 13 being obturated by contact with the bottom of the bore in the lower position of the plunger in this embodiment (position corresponding to the injection end).

This device is so designed as to permit injection through the nozzles of a determined fuel charge. This injection is effected by downwardly displacing the plunger under the action of a cam 14, rotated by the engine, against the action of a return spring 15.

This spring 15 is located between an annular shoulder 16 of the plunger 10 and a member 17 pressing against the bottom 18 of chamber 5, via an annular member 19. A metering ring 20 is rotatably mounted about the plunger 10 but its axial displacement relative to the injector body is prevented by the above arrangement.

At least a portion of the upper edge of the ring 20 forms a ramp 21 inclined to the plunger axis 10 (FIGS. 3 and 3A), this ramp controlling the beginning of the injection by obturating the port 12 of the duct 11 when the plunger 10 is moved towards the bottom 3 of the bore.

Means are provided to prevent the plunger 10 from rotating about its axis, said means comprising for example a stud engaging a groove parallel to this axis, the stud being for example carried by the injector body 1 and the groove being provided in the plunger wall or vice versa.

In the embodiment illustrated in FIG. 1, the means for preventing the plunger 10 from rotating about its axis are constituted by guiding grooves 22 respectively provided in the wall of the plunger 10 at its upper part and in a guide cover plate 23 secured to the injector body 1 at the upper end thereof.

Means for adjusting the relative angular position of the metering ring 20 and of the port 12 of the plunger permits regulation of the fuel quantity injected during each up and down stroke of the plunger.

Figure 4:
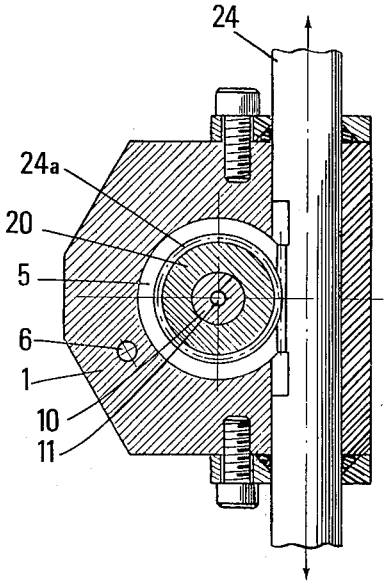
FIG. 4 is a cross-section at the level indicated in FIG. 1, showing the rack bar controlling the metering ring, FIGS. 5 to 8 diagrammatically illustrate the operation of the pump-injector unitary assembly.
Figure 3:
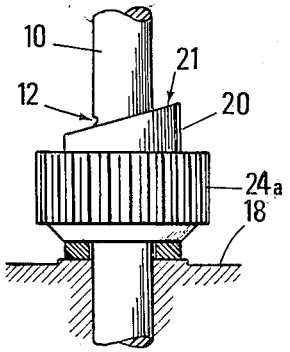
FIG. 3 is a partial view showing the metering ring.
Figure 3A:
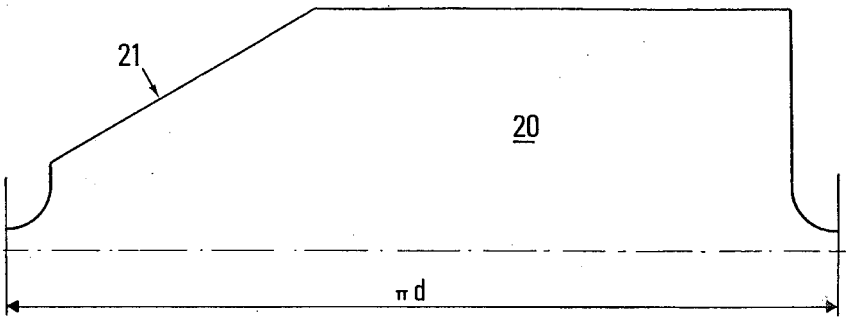
FIG. 3A is a developed view of the wall of said metering ring.

These means which may comprise a system of rods or linkage actuated by the gas pedal of the engine, may include, as in the embodiment illustrated in FIGS. 1, 3 and 4, a rack bar 24 cooperating with peripheral teeth 24*a* of the ring 20.

It would not depart from the scope of the present invention to use means for adjusting the relative angular positions of the metering ring and of the plunger, adapted to hold the ring 20 stationary in the device body and adjust the rotation of the plunger about its axis.

The operation of this pump-injector unitary assembly is diagrammatically illustrated in FIGS. 5 to 8, all the spaces or ducts of this device bein filled with fuel.

Figure 5:
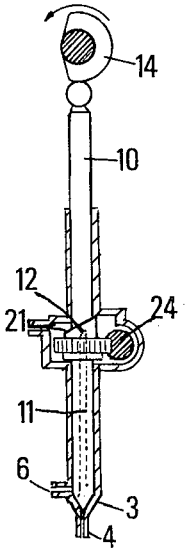
Figure 6:
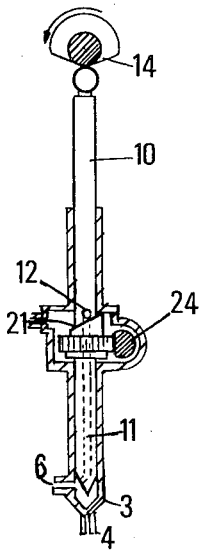

During the upward displacement of the plunger from the position illustrated in FIG. 5, fuel is first sucked as long as the discharge port 12 is obturated by the wall of the ring 20, then the filling of the lower part of the bore 2 with fuel is continued, due to the feeding pressure prevailing in the duct 6, up to the top dead center of the plunger 10 (position shown in FIG. 6). The entire volume between the plunger end and the bore bottom is then filled exclusively with fuel.

In this position of the plunger, the port 12 is located above the ramp 21 and the lower part of the bore 2 is filled with fuel which can flow from the duct 6, provided with the non-return valve 7, to the fuel tank (not shown) through the duct 11 of the plunger and the return duct 9 connected to the tank. This flow continues as long as the port 12 is not obturated by the metering ring.

Figure 7:
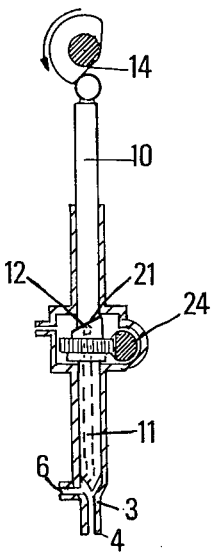

In the plunger position shown in FIG. 7, the port 12 of the duct 11 has moved beyond the ramp 21 during its downward stroke and this port is obturated by the internal wall of the metering ring 20. Thus fuel can no longer flow towards the return duct 9. As the plunger further moves towards the bottom 3 of the bore 2, fuel is discharged under pressure through the spray nozzles 4.

As it is clearly apparent, from the drawing, cooperation of the ramp 21 and of the port 12 controls, on the one hand, the fuel quantity which is entrapped at the lower part of the bore and, on the other hand, the beginning of the fuel injection through nozzles 4.

Figure 8:
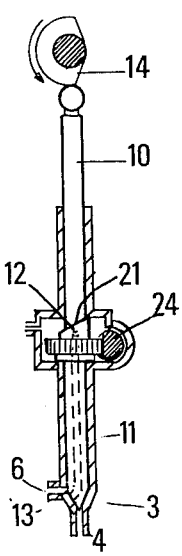

The injection ends when ths nozzles 4 are obturated by the tapered lower end of the plunger, in the position shown in FIG. 8.

A further rotation of the cam 14 causes the upward displacement of the plunger 10 under the action of the spring 15 and the lower part of the bore 2 is again filled with fuel, so that the above-described cycle is repeated.

As a result of to the inclination of the ramp 21 relative to the axis of the plunger 10, it is possible to vary the duration of obturation of the port 12 by the internal wall of the ring 20, to thereby achieve metering of the fuel charge injected during each cycle, by rotating the ring 20 about its axis by means of the rack bar 24.

With respect to the Cummins injection system described in the introductive part where fuel metering is achieved by varying the fuel supply pressure, the injector-pump device according to the invention is a system where fuel metering is mechanically achieved regardless of the fuel supply pressure, which presents a number of advantages comprising:

balancing of the flow rates through the different injectors in a multi-cylinder engine, such balancing being improved over the entire operational range of the engine (running speed-fuel charge);

flow regulation through a rack bar, i.e. by using a regulation means which is of conventional use in fuel injection pumps.

Moreover, this control system using a metering ring 20 is integral with the injector-pump unitary assembly and the displacements of the control member relative to the plunger 10 are limited to the requirements of the metering function itself (which may be of particular advantage for injecting high fuel charges).

In a modification of the embodiment illustrated in FIG. 1, it would be also possible, to achieve fuel metering by rotating the plunger 10, the ring 20 provided with the inclined ramp 21 then remaining stationary relative to the injector body.

According to another embodiment of the invention (not shown), whether or not the upper edge of the metering ring 20 forms an inclined ramp, the fuel metering is achieved by axial displacement of the ring 20 along the plunger 20 relative to the injector body, under the action of adjusting means whose manufacture is within the skill of the art.

In the embodiment illustrated in FIG. 1 the transfer passageway 11 is formed by a substantially axial bore in the plunger 10.

Figure 9:
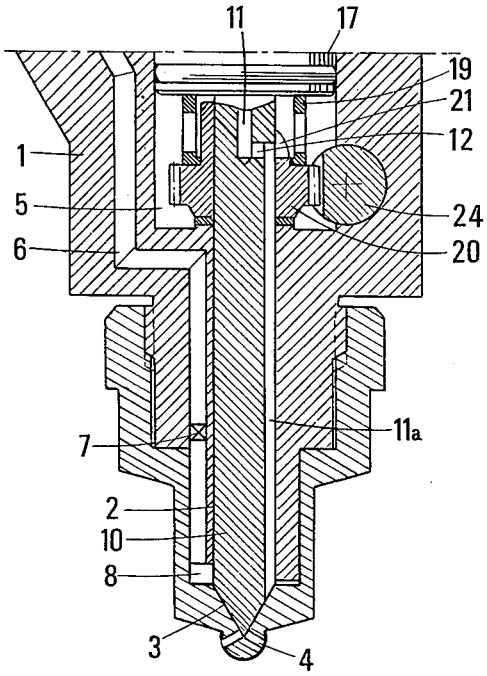
FIG. 9 illustrates another embodiment of the longitudinal fuel discharge duct.

In another embodiment (FIG. 9) the passageway is constituted by a longitudinal groove 11*a* provided on the plunger wall, this groove opening on the free end of this plunger.

It would obviously not depart from the scope of the present invention to substitute a helical groove for the rectilinear groove 11*a*.

In all the various embodiments, the lower end of the transfer passageway will preferably, but not necessarily, be located so that fuel flows from the fuel supply duct 6 to the transfer passageway 11, while scavenging at least a portion of the space defined between the bottom 3 of the bore 2 and the free end of the plunger 10.

As illustrated in FIG. 1, the injector-pump unitary assembly comprises at its upper part a push rod 25 slidably mounted in an axial cylindrical recess 26 of the plunger, the bottom of this recess communicating with the fuel longitudinal passageway 11 of the plunger 10.

An annular gasket 27 carried by the push rod 25 provides for fuel sealing.

This arrangement obviates the drawbacks which might result from a double mechanical stop or abutment: the first stop being at the contact of the cam with the upper end of the plunger 10 and the second stop being at the contact of the tapered end of the plunger with the bottom 3 of the bore 2 in the position of injection end shown in FIGS. 1 and 7.

Such a double stop or abutment may actually result in a defective operation of the device due to the two following difficulties:

risk of fluid leakage through the nozzles 4 after the injection end, if the tapered end of the plunger 10 is not applied with a sufficient force against the bottom 3, risk of a deterioration of the tapered end of the plunger and/or of its seat 3 if the force applying the plunger against the latter is too high.

This drawback is obviated with the selected embodiment where the pressurized fuel is used to compensate for the axial clearances resulting from the machining tolerance, from the wear, and from differences in thermal dilation, this pressurized fuel providing for a liquid stop or abutment.

The clearance $e_1$ (FIG. 1) will be of the order of some tenths of millimeter.

The clearance $e_2$ will be at least equal to $e_1$, but not too large, so as to avoid an excessive increase of the dead volume filled with fuel.

What is claimed is:

1. A fuel pump-injector unitary assembly for an internal combustion engine, comprising an injector body having an axial bore with the bottom traversed by at least one fuel spray nozzle, at least one fuel inlet duct opening in said axial bore near the bottom thereof, a plunger or needle slidable in said bore between a first position wherein said plunger is spaced from the bore bottom, and a second position corresponding to the position of the end of injection, where the tapered lower end of the plunger obturates the spray nozzles, said pump-injector unitary assembly comprising means for metering the fuel quantity injected through said spray nozzle, said metering means comprising a transfer passageway provided in the plunger and communicating at a first end with a fuel discharge duct when the plunger is in its first position, with said fuel discharge duct opening through the wall of said axial bore, a metering ring surrounding said plunger and located in an annular chamber of the injector body, with said bore and said discharge duct opening in said annular chamber, and said metering ring having an upper edge of which at least a portion co-operates with the first end of said transfer passageway to effect fuel metering, and means for regulating the position of the ring in the injector body, said transfer passageway having its second end opening at the free or lower end of the plunger and said portion of the upper edge of the metering ring defining the beginning of the injection by obturating said first end of said longitudinal passageway.

2. A pump-injector unitary assembly according to claim 1, wherein said portion of the upper edge of the metering ring defines a ramp inclined to the plunger axis, and wherein the relative angular position of the ring with respect to the plunger is adjustable by said regulating means.

3. A pump-injector assembly according to claim 1, wherein said regulating means is adapted to control an axial displacement of the metering ring relative to the injector body.

4. A pump-injector assembly according to claim 2, further comprising means for preventing the rotation of the plunger with respect to the injector body.

5. A pump-injector assembly according to claim 4, wherein said means for preventing rotation of the plunger comprises a plurality of guide grooves.

6. A pump-injector assembly according to claim 2, wherein said means for adjusting the relative angular position of the ring and the plunger comprises a rack bar co-operating with peripheral teeth of said ring.

7. A pump-injector assembly according to claim 1, 2, 3, 4, 5 or 6 further comprising a push-rod co-operating with means for displacing the plunger, wherein said push-rod is slidable in a cylindrical axial recess of the plunger which communicates with said fuel discharge duct.

8. A pump-injector assembly according to claim 1, wherein said transfer passageway is an axial bore of the plunger.

9. A pump-injector assembly according to claim 1, wherein said transfer passageway is a groove provided in the wall of the plunger.

10. A pump-injector assembly according to claim 9, wherein the direction of extension of said groove has at least one axial component.

* * * * *

UNITED STATES PATENT AND TRADEMARK OFFICE

CERTIFICATE OF CORRECTION

PATENT NO. : 4,394,964

DATED : July 26, 1983

INVENTOR(S) : Andre Ecomard; Philippe Pinchon

It is certified that error appears in the above-identified patent and that said Letters Patent is hereby corrected as shown below:

Claim 1, col. 6, lines 7-8; delete "with said fuel discharge duct opening through the wall of said axial bore,".

Signed and Sealed this

*Twenty-fourth* Day of *January 1984*

[SEAL]

*Attest:*

GERALD J. MOSSINGHOFF

*Attesting Officer*

*Commissioner of Patents and Trademarks*